US008905823B2

(12) United States Patent
Wu et al.

(10) Patent No.: US 8,905,823 B2
(45) **Date of Patent: *Dec. 9, 2014**

(54) CORROSION-RESISTANT CMP CONDITIONING TOOLS AND METHODS FOR MAKING AND USING SAME

(75) Inventors: Jianhui Wu, Ashland, MA (US); Taewook Hwang, Acton, MA (US); Ramanujam Vedantham, Worcester, MA (US); Charles Dinh-Ngoc, Holliston, MA (US); Thomas K. Puthanangady, Shrewsbury, MA (US); Eric M. Schulz, Worcester, MA (US); Srinivasan Ramanath, Holden, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

This patent is subject to a terminal disclaimer.

(21) Appl. No.: 12/791,391

(22) Filed: Jun. 1, 2010

(65) Prior Publication Data

US 2010/0330886 A1 Dec. 30, 2010

Related U.S. Application Data

(60) Provisional application No. 61/183,284, filed on Jun. 2, 2009, provisional application No. 61/235,980, filed on Aug. 21, 2009.

(51) Int. Cl.

| | |
|---|---|
| ***B24B 53/12*** | (2006.01) |
| ***B24B 53/017*** | (2012.01) |
| ***B24D 3/08*** | (2006.01) |
| ***B24D 18/00*** | (2006.01) |

(52) U.S. Cl.

CPC ..... *B24B 53/017* (2013.01); *B24D 3/08* (2013.01); *B24B 53/12* (2013.01); *B24D 18/00* (2013.01)

USPC ..... 451/443; 451/548; 51/307

(58) Field of Classification Search

USPC ..... 451/56, 443, 548; 51/307–309

See application file for complete search history.

(56) References Cited

U.S. PATENT DOCUMENTS

| | | | |
|---|---|---|---|
| 2,175,073 | A | 10/1939 | Amstuz |
| 2,194,472 | A | 3/1940 | Jackson |

(Continued)

FOREIGN PATENT DOCUMENTS

| | | | |
|---|---|---|---|
| CN | 1286158 | A | 3/2001 |
| CN | 1373499 | A | 10/2002 |

(Continued)

OTHER PUBLICATIONS

English abstract of Japanese Patent Publication No. JP3895840B2, published on Mar. 22, 2007. Applicant Asahi Diamond Kogyo KK.

(Continued)

*Primary Examiner* — Maurina Rachuba

(74) *Attorney, Agent, or Firm* — Abel Law Group, LLP; Joseph P. Sullivan

(57) ABSTRACT

An abrasive tool for conditioning CMP pads includes abrasive grains coupled to a substrate through a metal bond and a coating, e.g., a fluorine-doped nanocomposite coating. The abrasive grains can be arranged in a self-avoiding random distribution. In one implementation, an abrasive tool includes a coated plate and a coated abrasive article that has two abrading surfaces. Other implementations related to a process for producing an abrasive tool that includes a coating at one or more of its surfaces. Also described are methods for dressing a CMP pad.

18 Claims, 5 Drawing Sheets

(56) References Cited

U.S. PATENT DOCUMENTS 2,785,060 A 3/1957 Keeleric
2,820,746 A 1/1958 Keeleric
3,243,925 A 4/1966 Buzzell
3,341,984 A * 9/1967 Sickle et al. ..... 451/490
RE26,879 E 5/1970 Kelso
3,990,124 A 11/1976 MacKay, Jr. et al.
4,018,576 A 4/1977 Lowder et al.
4,222,204 A 9/1980 Benner
4,818,515 A 4/1989 Ceresa et al.
4,925,457 A 5/1990 Dekok et al.
4,931,069 A 6/1990 Wiand
4,951,423 A 8/1990 Johnson
4,968,326 A 11/1990 Wiand
5,014,468 A 5/1991 Ravipati et al.
5,049,165 A 9/1991 Tselesin
5,152,917 A 10/1992 Pieper et al.
5,219,462 A 6/1993 Bruxvoort et al.
5,304,223 A 4/1994 Pieper et al.
5,352,493 A * 10/1994 Dorfman et al. ..... 427/530
5,382,189 A 1/1995 Arendall
5,456,627 A 10/1995 Jackson et al.
5,466,431 A * 11/1995 Dorfman et al. ..... 423/446
5,472,461 A 12/1995 Li
5,492,771 A 2/1996 Lowder et al.
5,511,718 A 4/1996 Lowder et al.
5,626,509 A 5/1997 Hayashi
5,645,474 A 7/1997 Kubo et al.
5,660,881 A 8/1997 Okamura
5,667,433 A 9/1997 Mallon
5,669,943 A 9/1997 Horton et al.
5,683,289 A 11/1997 Hempel, Jr.
5,791,975 A 8/1998 Cesna et al.
5,795,648 A * 8/1998 Goel et al. ..... 428/336
5,833,724 A 11/1998 Wei et al.
5,842,912 A 12/1998 Holzapfel et al.
5,851,138 A 12/1998 Hempel, Jr.
5,863,306 A 1/1999 Wei et al.
5,919,084 A 7/1999 Powell et al.
5,921,856 A * 7/1999 Zimmer ..... 451/539
5,976,204 A 11/1999 Hammarstrom et al.
5,980,678 A 11/1999 Tselesin
6,022,266 A 2/2000 Bullard et al.
6,027,659 A 2/2000 Billett
6,039,641 A 3/2000 Sung
6,059,638 A 5/2000 Crevasse et al.
6,096,107 A 8/2000 Caracostas et al.
6,099,603 A 8/2000 Johnson
6,123,612 A 9/2000 Goers
6,136,043 A 10/2000 Robinson et al.
6,136,143 A 10/2000 Winter et al.
6,159,087 A 12/2000 Birang et al.
6,200,675 B1 * 3/2001 Neerinck et al. ..... 428/336
6,234,883 B1 5/2001 Berman et al.
6,258,139 B1 7/2001 Jensen
6,261,167 B1 7/2001 Watson et al.
6,263,605 B1 * 7/2001 Vanell ..... 451/443
6,286,498 B1 9/2001 Sung
6,288,648 B1 9/2001 Easter et al.
6,293,980 B2 9/2001 Wei et al.
6,309,433 B1 10/2001 Kinoshita
6,341,739 B1 1/2002 Hogg
6,347,982 B1 2/2002 Holzapfel
6,358,133 B1 3/2002 Cesena et al.
6,364,742 B1 4/2002 Fukuzawa
6,368,198 B1 * 4/2002 Sung et al. ..... 451/443
6,390,908 B1 5/2002 Chen et al.
6,390,909 B2 5/2002 Foster et al.
6,402,603 B1 6/2002 Watson et al.
6,416,878 B2 7/2002 An
6,419,574 B1 7/2002 Takahashi et al.
6,439,986 B1 8/2002 Myoung et al.
6,468,642 B1 * 10/2002 Bray et al. ..... 428/216
6,475,072 B1 11/2002 Canaperi et al.
6,495,464 B1 12/2002 Boyd et al.
6,508,697 B1 * 1/2003 Benner et al. ..... 451/443
6,511,713 B2 1/2003 Mathisen et al.
6,537,140 B1 3/2003 Miller et al.
6,572,446 B1 6/2003 Osterheld et al.
6,575,353 B2 6/2003 Palmgreen
6,626,167 B2 9/2003 Kim et al.
6,626,747 B1 9/2003 Sidebottom
6,641,471 B1 11/2003 Pinheiro et al.
6,679,243 B2 1/2004 Sung
6,699,106 B2 3/2004 Myoung et al.
6,769,975 B2 8/2004 Sagawa
6,818,029 B2 11/2004 Myoung et al.
6,821,189 B1 11/2004 Coad et al.
6,887,138 B2 5/2005 Bottema et al.
6,893,336 B2 5/2005 Jin
6,945,857 B1 9/2005 Doan et al.
7,066,795 B2 6/2006 Balagani et al.
7,124,753 B2 10/2006 Sung
7,217,172 B2 5/2007 Benner
7,258,708 B2 8/2007 Sung
7,300,338 B2 11/2007 Wielonski et al.
7,384,436 B2 6/2008 Sung
7,467,989 B2 12/2008 Lin et al.
7,507,267 B2 3/2009 Hall et al.
7,544,114 B2 6/2009 Orlhac
7,575,503 B2 8/2009 Benner
7,641,538 B2 1/2010 Goers
7,993,419 B2 8/2011 Hall et al.
8,096,858 B2 1/2012 Sakamoto et al.
8,342,910 B2 1/2013 Dinh-Ngoc et al.
8,657,652 B2 2/2014 Hwang et al.
2002/0068518 A1 6/2002 Cesena et al.
2002/0072302 A1 6/2002 Robinson et al.
2002/0127962 A1 9/2002 Cho et al.
2002/0173234 A1 * 11/2002 Sung et al. ..... 451/21
2002/0182401 A1 12/2002 Lawing
2002/0184829 A1 12/2002 Lemberger et al.
2002/0197947 A1 12/2002 Sagawa
2003/0036341 A1 2/2003 Myoung et al.
2003/0114094 A1 6/2003 Myoung et al.
2003/0205239 A1 11/2003 Cho et al.
2004/0009742 A1 1/2004 Lin et al.
2004/0031438 A1 2/2004 Sung
2004/0037948 A1 2/2004 Tank et al.
2004/0072510 A1 4/2004 Kinoshita et al.
2004/0137829 A1 7/2004 Park et al.
2004/0180617 A1 9/2004 Goers
2004/0198206 A1 10/2004 Toge et al.
2005/0025973 A1 * 2/2005 Slutz et al. ..... 428/408
2005/0076577 A1 4/2005 Hall et al.
2005/0085169 A1 4/2005 Cooper et al.
2005/0097824 A1 5/2005 Braunschweig et al.
2005/0118820 A1 6/2005 Akahori et al.
2005/0153634 A1 7/2005 Prasad et al.
2005/0214201 A1 9/2005 Maruno et al.
2005/0215188 A1 9/2005 Toge et al.
2005/0260922 A1 11/2005 Gan
2005/0276979 A1 * 12/2005 Slutz et al. ..... 428/408
2006/0010780 A1 * 1/2006 Hall et al. ..... 51/293
2006/0073774 A1 4/2006 Sung
2006/0079162 A1 4/2006 Yamashita et al.
2006/0160477 A1 7/2006 Kinoshita et al.
2006/0213128 A1 9/2006 Sung
2006/0254154 A1 11/2006 Huang et al.
2007/0049185 A1 3/2007 Lin et al.
2007/0060026 A1 3/2007 Sung et al.
2007/0066194 A1 3/2007 Wielonski et al.
2007/0072527 A1 3/2007 Palmgren
2007/0235801 A1 10/2007 Cheng et al.
2007/0259609 A1 11/2007 Iiyoshi et al.
2008/0004743 A1 1/2008 Goers et al.
2008/0132153 A1 6/2008 Rikita et al.
2008/0153398 A1 6/2008 Sung
2008/0193649 A1 8/2008 Jacquet et al.
2008/0248734 A1 10/2008 Bajaj
2008/0271384 A1 11/2008 Puthanangady et al.
2009/0053980 A1 2/2009 Hwang et al.
2009/0077900 A1 3/2009 Chuda et al.
2009/0202781 A1 8/2009 Hall et al.
2009/0206304 A1 * 8/2009 Dziomkina ..... 252/589

(56) References Cited

U.S. PATENT DOCUMENTS

| | | | | |
|---|---|---|---|---|
| 2009/0270792 | A1 | 10/2009 | Lastovich et al. | |
| 2009/0275274 | A1 | 11/2009 | Sakamoto et al. | |
| 2010/0022174 | A1 | 1/2010 | Chou et al. | |
| 2010/0248595 | A1* | 9/2010 | Dinh-Ngoc et al. | 451/56 |
| 2010/0330886 | A1* | 12/2010 | Wu et al. | 451/56 |
| 2011/0097977 | A1* | 4/2011 | Bubnick et al. | 451/56 |
| 2011/0252710 | A1 | 10/2011 | Hall et al. | |
| 2012/0122377 | A1 | 5/2012 | Wu et al. | |
| 2012/0220205 | A1 | 8/2012 | Wu et al. | |
| 2013/0078895 | A1 | 3/2013 | Dinh-Ngoc et al. | |
| 2013/0219801 | A1 | 8/2013 | Liebelt et al. | |
| 2013/0316630 | A1 | 11/2013 | Rothenberg et al. | |

FOREIGN PATENT DOCUMENTS

| | | | |
|---|---|---|---|
| CN | 1482959 | A | 3/2004 |
| DE | 69210221 | T2 | 1/1997 |
| DE | 10109892 | A1 | 9/2002 |
| DE | 10296547 | T5 | 5/2006 |
| EP | 1020303 | A1 | 7/2000 |
| EP | 1208945 | A1 | 5/2002 |
| EP | 1297928 | A1 | 4/2003 |
| EP | 1346797 | A | 9/2003 |
| FR | 2860744 | A1 | 4/2005 |
| GB | 2423491 | B | 8/2006 |
| JP | 04250978 | A | 9/1992 |
| JP | 200052254 | A | 2/2000 |
| JP | 2000-127046 | A | 5/2000 |
| JP | 2001018172 | A | 1/2001 |
| JP | 3261687 | B2 | 3/2002 |
| JP | 20020178264 | | 6/2002 |
| JP | 2002-200553 | A | 7/2002 |
| JP | 200353665 | | 2/2003 |
| JP | 2003048163 | A | 2/2003 |
| JP | 2003094332 | A | 4/2003 |
| JP | 2003117822 | A | 4/2003 |
| JP | 2003-305644 | A | 10/2003 |
| JP | 2004025377 | A | 1/2004 |
| JP | 2004066409 | A | 3/2004 |
| JP | 2004202639 | A | 7/2004 |
| JP | 2007083352 | A | 4/2007 |
| JP | 2007109767 | A | 4/2007 |
| JP | 04084944 | B2 | 4/2008 |
| JP | 2008114334 | A | 5/2008 |
| JP | 2008186998 | A | 8/2008 |
| JP | 2008229775 | A | 10/2008 |
| KR | 20010032812 | A | 4/2001 |
| KR | 20020036138 | A | 5/2002 |
| KR | 20-0298920 | Y1 | 1/2003 |
| KR | 10-2009-0013366 | A | 2/2009 |
| WO | 9845092 | A1 | 10/1998 |
| WO | 99/43491 | A1 | 9/1999 |
| WO | 2005039828 | A1 | 5/2005 |
| WO | 2007/149683 | A2 | 12/2007 |
| WO | 2008002735 | A2 | 1/2008 |
| WO | 2008036892 | A1 | 3/2008 |
| WO | 2009/026419 | A1 | 2/2009 |
| WO | 2010/110834 | A1 | 9/2010 |
| WO | 2010/141464 | A2 | 12/2010 |
| WO | 2012/004376 | A1 | 1/2012 |
| WO | 2013/166375 | A1 | 11/2013 |

OTHER PUBLICATIONS

International Search Report and Written Opinion of the International Searching Authority mailed Mar. 14, 2011, from counterpart International Application No. PCT/US2010/036895, filed on Jun. 1, 2010.

De Pellegrin, D.V., t al., "The Measurement and Description of Diamond Shape in Abrasion," Department of Mechanical and Manufacturing Engineering, Univeristy of Dublin, Ireland, 16 pgs.

Elmufdi, Carolina, L., et al., "The Impact of Pad Microtexture and Materials Properties on Surface Contact and Defectivity in CMP," Pad Engineering Research Group, 11th International CMP Symposium, Lake Placid, NY, Aug. 15, 2006, 18 pgs.

Hwang, Taewook et al., "Advanced Pad Conditioner Design for Oxide/Metal CMP." Saint-Gobain High Performance Materials, Transactions on Electrical and Electronic Materials, vol. 7, No. 2, Apr. 2006, pp. 62-66.

Hwang, Taewook et al., "Optimized and Customized CMP Conditioner Design for Next Generation Oxide/Metal CMP," Saint-Gobain High Performance Materials, 6 pgs.

International Search Report Written Opinion of the International Searching Authority mailed, from counterpart International Application No. PCT/US2009/069961.

Lawing, A. Scott, "Pad Conditioning and Textural Effects in Chemical Mechanical Polishing," Rohm and Haas Electronic Materials CMP Technologies, CMP-MIC Conference, Feb. 23-25, 2005, pp. 33-42.

Popp U, eta l., "Properties of nanocrysatlline ceramic powder preparation by laser evaporation and recondensation," Nanocrystal, Jan. 1, 1998, vol. 18, No. 9.

PCT/US2007/079154, International Search Report mailed Jan. 18, 2008, 3 pages.

PCT/US2004/028881, International Search Report mailed Dec. 23, 2004, 4 pages.

PCT/US2008/073823, International Search Report mailed Nov. 26, 2008, 2 pages.

Li et al, The effect of the polishing pad treatments on the chemical-mechanical polishing of SiO2 films; Thin Solid Films 270 (1995) pp. 601-606.

Stavreva et al, Characteristics in chemical-mechanical polishing of copper: comparison of polishing pads; Applied Surface Science 108 (1997) pp. 39-44.

Chan et al, A preliminary study of gentle CVDD pad dressers potential for fixed abrasives conditioning; Nov. 19-20, 2002 VMIC Conference, 2002 IMIC-400/00/0395; pp. 395-398.

Sung; CMP pad dresser: A diamond grid solution; DiaGrid(r) CMP conditioner; pp. 0-41; Kinik Co., Taiwan.

Koshy et al, surface generation with engineered diamond grinding wheels; insights from simulation; McMaster Manufacturing Research Institute; McMaster University, Hamilton, Canada; pp. 271-274.

"Diamond Grain Mesh Size/Grit Size", http://www.china-superabrasives.com/diamond_mesh_size.htm.

"Abrasive and Compounds," http://www.newportglass.com/grit.htm.

International Search Report for PCT/US2007/079154 mailed Jan. 18, 2008, 1 page.

International Search Report for PCT/US2013/039447 mailed Sep. 17, 2013, 1 page.

International Search Report for PCT/US2010/047306 mailed Mar. 31, 2011, 1 page.

"Electrical Discharge Machining" Wikipedia, 6 pages.

* cited by examiner

CORROSION-RESISTANT CMP CONDITIONING TOOLS AND METHODS FOR MAKING AND USING SAME

RELATED APPLICATIONS

This application claims the benefit under 35 USC 119(e) of (i) U.S. Provisional Patent Application No. 61/183,284, filed on Jun. 2, 2009, with the title Corrosion Resistant CMP Conditioning Tools and Methods for Making and Using Same, and (ii) U.S. Provisional Patent Application 61/235,980, filed Aug. 21, 2009, with the title Abrasive Tool for Use as a Chemical Mechanical Planarization Pad Conditioner, both applications being incorporated herein by reference in their entirety.

BACKGROUND

Chemical mechanical polishing or planarization (CMP) processes are carried out to produce flat (planar) surfaces on a variety of materials including semiconductor wafers, glasses, hard disc substrates, sapphire wafers and windows, plastics and so forth. Typically, CMP processes involve use of a polymeric pad and a slurry that contains loose abrasive particles and other chemical additives to make possible the removal process by both chemical and mechanical actions.

During the process, the polishing pad becomes glazed with polishing residues and a conditioner is typically used to condition or dress polishing pads. Generally, tools for conditioning CMP pads, also known as CMP conditioners, or CMP dressers, are fabricated by using a metal bond (electroplated, brazed or sintered) to fix abrasive particles to a preform and create a tool surface that can condition polishing pads. In some cases, the conditioner not only conditions the glazed surface of the pad but can also generate pad texture or topography which can influence wafer surface quality. Inappropriate conditioning of the polishing pad can produce microscratches on the polished wafer surface and increase dishing.

CMP conditioners that are based on stainless steel substrates and manufactured through brazing or powder metal sintering technologies, tend to be susceptible to chemical attacks in highly corrosive environments, such as highly acidic tungsten (W) or copper (Cu) slurries, leading to premature failure of the conditioner. For instance, braze components such as nickel (Ni), chromium (Cr), and others are leached out of the bonding system, forming a porous metal bond microstructure, often at both surface and subsurface levels. In turn this accelerates the corrosion process due to increased surface area. Higher trace metal contents in the applied CMP slurry, also can lead to potential wafer contaminations.

SUMMARY

A need exist therefore, for tools and techniques for conditioning polishing pads that reduce or minimize the corrosive effects described above.

Some aspects of the invention relate to a tool for conditioning a CMP pad. In specific implementations, the tool has two (first and second) working (abrading) surfaces that are opposite to one another. Tools in which only one surface is an abrading surface also can be utilized. Some of the abrasive tools include a plate or holder and suitable means for removably coupling the abrasive portion of the tool with the plate.

One or more parts of the tool are coated. In some cases, all metal-containing surfaces that come into contact with CMP fluids are coated. In other cases, the entire tool, including, for instance, all abrading surface(s), non-working surfaces, e.g., side surfaces or surfaces that do not include abrasive grains, plate (in those designs that employ such a fixture) and so forth, are coated. The coating can be a fluorinated nanocomposite coating, for instance a nanocomposite containing carbon, silicon, oxygen, and doped fluorine. Hydrogen or additional dopants also can be present in the coating. Other suitable coatings include polymer, diamond-like carbon, fluorinated nanocomposite, plated metal and others. In one example, the coating is hydrophobic. In another example, the coating has corrosion-resistant properties.

In one embodiment, a tool for conditioning a CMP pad includes abrasive grains coupled to a substrate through a metal bond and a coating to one or more surfaces of the tool. In some implementations, the abrasive grains have a selected maximum diameter and a selected size range, and are adhered in a single layer array to the substrate by the bond, characterized in that the abrasive grains are oriented in the array according to a non-uniform pattern having an exclusionary zone around each abrasive grain, each exclusionary zone having a minimum diameter that exceeds the maximum diameter of the desired abrasive grain grit size.

Other aspects of the invention relate to a method for manufacturing a tool for dressing a CMP pad.

In one embodiment, a method for manufacturing an abrasive tool for conditioning a CMP pad, the tool having individual abrasive grains placed in a controlled, random spatial array such that the individual grains are non-contiguous, includes: (i) coupling abrasive grains to a substrate to form a fired tool, wherein the tool is prepared by a process comprising: (a) selecting a two-dimensional planar area having a defined size and shape; (b) selecting a desired abrasive grain grit size and concentration for the planar area; (c) randomly generating a series of two-dimensional coordinate values; (d) restricting each pair of randomly generated coordinate values to coordinate values differing from any neighboring coordinate value pair by a minimum value (k); (e) generating an array of the restricted, randomly generated coordinate values having sufficient pairs, plotted as points on a graph, to yield the desired abrasive grain concentration for the selected two dimensional planar area and the selected abrasive grain grit size; and (f) centering an abrasive grain at each point on the array; (ii) firing the tool; and (iii) applying a coating on at least one surface of the fired tool.

In another embodiment, a method for manufacturing abrasive tools having individual abrasive grains placed in a controlled, random spatial array such that the individual grains are non-contiguous, includes: (i) coupling abrasive grains to a substrate to form a fired tool, wherein the tool is prepared by a process comprising the steps of: (a) selecting a two-dimensional planar area having a defined size and shape; (b) selecting a desired abrasive grain grit size and concentration for the planar area; (c) selecting a series of coordinate value pairs (x1, y1) such that the coordinate values along at least one axis are restricted to a numerical sequence wherein each value differs from the next value by a constant amount; (d) decoupling each selected coordinate value pair (x1, y1) to yield a set of selected x values and a set of selected y values; (e) randomly selecting from the sets of x and y values a series of random coordinate value pairs (x, y), each pair having coordinate values differing from coordinate values of any neighboring coordinate value pair by a minimum value (k); (f) generating an array of the randomly selected coordinate value pairs having sufficient pairs, plotted as points on a graph, to yield the desired abrasive grain concentration for the selected two dimensional planar area and the selected abrasive grain grit size; and (g) centering an abrasive grain at each point on the array; and (ii) applying a coating on a working surface of the tool.

In a further embodiment a method for manufacturing an abrasive tool for conditioning a CMP pad includes coating a CMP conditioner that has abrasive grains coupled to a substrate via a metal bond by a process comprising: (a) positioning the CMP conditioner in a vacuum deposition chamber; and (b) depositing a composition containing carbon, silicon, oxygen, hydrogen, and fluorine onto it by co-deposition of clusterless particle beams that include ions, atoms, or radicals of the carbon, silicon, oxygen, hydrogen, and fluorine, wherein the mean free path of each particle species is in excess of the distance between its source and the growing particle coating surface of the conditioner.

In yet another embodiment, a method for manufacturing an abrasive tool for conditioning a CMP pad comprises coating at least one surface of a CMP conditioner that includes abrasive grains coupled to a substrate through a metal bond, by a process comprising applying a fluorine-doped nanocomposite coating to the at least one surface of the CMP conditioner via co-deposition by clusterless beams of ions, atoms or radicals of the relevant elements, where the mean free path of each particle species preferably exceeds the distance between its source and the growing particle coating surface, and each beam contains particles of well-defined energy.

Further aspects of the invention relate to a method of conditioning a CMP pad.

In one embodiment, a method for conditioning a CMP pad, comprises: dressing a surface of the CMP pad with a tool that includes (a) abrasive grains coupled to a substrate through a metal bond, the abrasive grains having a selected maximum diameter and a selected size range, and the abrasive grains being adhered in a single layer array to the substrate by the bond, characterized in that the abrasive grains are oriented in the array according to a non-uniform pattern having an exclusionary zone around each abrasive grain, each exclusionary zone having a minimum diameter that exceeds the maximum diameter of the desired abrasive grain grit size; and (b) a coating at one or more surfaces of the tool.

In another embodiment, a method for conditioning a CMP pad, comprises: (a) contacting a dresser with the CMP pad, wherein the dresser includes abrasive grains coupled to a substrate through a metal bond and a nanocomposite coating that contains carbon, silicon, oxygen, hydrogen, and fluorine at one or more surfaces of the dresser; and (b) refurbishing a working surface of the CMP pad, thereby conditioning said pad.

In a further embodiment, a method of dressing a CMP pad includes coupling an abrasive article to a dressing machine, the abrasive article comprising a substrate having a first major surface and a second major surface opposite the first major surface, wherein the abrasive article comprises a first abrasive surface at the first major surface of the substrate, and a second abrasive surface at the second major surface of the substrate, at least one of said abrasive surfaces being coated, and wherein the abrasive article is mounted on the dressing machine to expose the first abrasive surface; contacting the first abrasive surface to a surface of a first CMP pad and moving the first CMP pad relative to the first abrasive surface to condition the first CMP pad; inverting the abrasive article to expose the second abrasive surface; and contacting the second abrasive surface to a surface of a second CMP pad and moving the second CMP pad relative to the second abrasive surface to condition the second CMP pad.

The invention can be practiced with many types of CMP dressers and has many advantages. For example, tools for conditioning CMP pads are provided with a coating that preferably is hydrophobic, thus reducing or minimizing CMP residue buildup and the formation of tribological films. As a result, the dresser performance can be maximized or enhanced, since the diamonds will be in effect until all the performing sharp edges are dulled. Coated CMP conditioners described herein preferably are resistant to corrosion and/or erosion, peeling or delamination. Some of the coatings employed are extremely hard and long lasting and can be "tuned" or altered as desired, e.g., by manipulating their chemical composition, to obtain the best combination of properties for a particular CMP application.

The inert nature of some of the coatings described (e.g., F-DNC, further discussed below) makes CMP dressers particularly well suited for harsh CMP applications such as W or Cu CMP. On one hand, the coating itself will not react with the low-PH metal CMP slurries; on the other hand, the hydrophobic coating can also prevent the chemical leaching of alloy components from the subsurface braze microstructure. Therefore minimized metal contamination on polished wafer surface can be achieved. In some implementations, tools disclosed herein are particularly useful for CMP environments such as found, for instance, in Interlayer Dielectric (ILD) or Shallow Trench Isolation (STI) applications.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
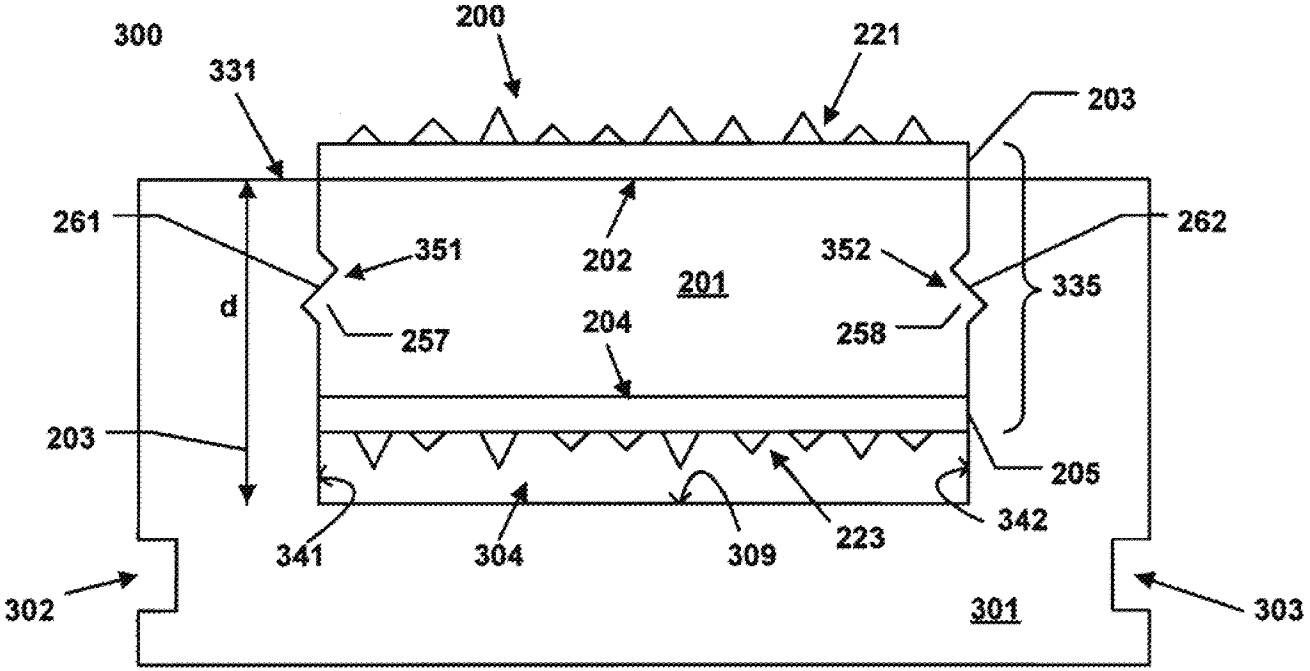
FIG. 1 includes a cross-sectional illustration of a portion of an abrasive tool.

The invention generally relates to tools for conditioning CMP pads, methods for making and methods for using such tools.

In one embodiment, the invention is directed to a tool for conditioning CMP pads. The tool includes abrasive grains coupled to a support member (also referred to herein as a substrate) and a coating.

Typically, support members utilized in tools for conditioning CMP pads have at least two sides or faces typically opposite one another (e.g., front and back), also referred herein as major surfaces. Disk-like or cylindrical shapes are typical but other configurations also can be utilized. The front side and the back side of the support can be substantially parallel to one another and, in some cases, the tool is manufactured to have an out-of-flatness of less than about 0.002 inch. For example, the tool may have an out-of-flatness, of less than about 0.01 inches, and in some cases, less than about 0.002 inches.

Support members can be made, in whole or in part, of metal alloys, polymeric materials or combinations of metal, metal alloys and/or polymers. Other materials also can be employed. Typically, the support member (or substrate) is made of a material suitable for withstanding the rigors of abrasive processing. For instance, the substrate can utilize a material having an elastic modulus of at least 2E3 MPa. In other embodiments, the substrate may be made of a material having a greater elastic modulus, such as on the order of at least about 5E3 MPa, such as at least about 1E4 MPa, or even at least about 1E5 MPa. In particular instances, the substrate material has an elastic modulus within a range between about 2E3 MPa and about 4E5.

A plurality of abrasive particles (grains or grits) is coupled to one or more surfaces of the support member. Tools for conditioning CMP pads can utilize superabrasives, for example, diamond, e.g., natural or synthetic, cubic boron nitride (CBN) or other abrasives such as oxides, e.g., alumina, silica, borides, nitrides, carbides, e.g., silicon carbide, carbon-based structures (including man-made carbon-based materials such as fullerenes), or combinations of different types of abrasives and/or superabrasives. In specific implementations diamond abrasive grains are coupled (attached) to a substrate, e.g., a disk-like substrate, that is made of stainless steel.

The abrasive grains have a size suitable for a specific application. In some CMP conditioners, for instance, at least 50% (by weight) of the abrasive particles, e.g., diamond particles, have a particle size of less than 75 micrometers (μm). In other examples, at least about 95% (by weight) of the abrasive particles have a particle size of less than about 85 μm.

In other implementations, the abrasive grains have an average grit size that is less than about 250 microns. In some instances smaller abrasive grains may be used such that the average grit size is not greater than about 200 microns, not greater than about 100 microns, or even not greater than about 50 microns. In particular examples, the abrasive grains have an average grit size within a range between about 1 micron and about 250 microns, such as within a range between about 1 micron and about 100 microns.

In an embodiment, abrasive grains are coupled to one side, while the second side is provided with a metal bond that contains no abrasive grains or contains inert (with respect to the tool manufacturing process) filler particles.

Other arrangements can be employed. For instance U.S. patent application Ser. No. 12/651,326, with the title of Abrasive Tool for Use as a Chemical Planarization Pad Conditioner, filed Dec. 31, 2009, which is incorporated herein by reference in its entirety, describes an abrasive tool for use as a CMP pad conditioner (dresser) that includes an abrasive article having two (first and second) abrading surfaces. The tool can be provided with coupling means for removably coupling the abrasive article with a fixture or plate (also referred to herein as a holder) that can be made from metals, metal alloys, polymers or a combination thereof. In some cases, the plate includes transition metal elements. The abrasive tool can include different types of engagement structures facilitating removal and/or reversing of the abrasive tool such that both first and second abrading surfaces are useable.

For example, an abrasive tool for use as a CMP pad conditioner comprises a plate, and an abrasive article that includes a substrate having a first major surface and a second major surface opposite the first major surface. The CMP pad conditioner also includes a first layer of abrasive grains attached to the first major surface, a second layer of abrasive grains attached to the second major surface, and an engagement structure configured to engage a portion of the plate and removably couple the abrasive article and the plate.

Other examples relate to an abrasive tool for use as a CMP pad conditioner including a plate and an abrasive article having a substrate including a first major surface and a second major surface opposite the first major surface, a first layer of abrasive grains attached to the first major surface, and a second layer of abrasive grains attached to the second major surface. The abrasive tool is formed such that the plate and abrasive article are removably coupled via a coupling mechanism.

A cross-sectional illustration of an abrasive tool that can be employed is shown in FIG. 1. In particular, abrasive tool 300 includes an abrasive article 250 that is removably coupled to a plate 301. The abrasive article 250 includes a substrate 201 with a first major surface 202 and a second surface 204 opposite the first major surface 202 that are joined by side surfaces. The abrasive article 250 further includes a first bonding layer 203 overlying and abutting the first major surface 202, and a first layer of abrasive grains 221 contained within the bonding layer 203, such that the abrasive grains are secured to the substrate 201. Also illustrated is a second bonding layer 205 overlying and abutting the second major surface 204, and a second layer of abrasive grains 223 contained within the bonding layer 205, such that the abrasive grains are secured to the substrate 201.

Plate 301 includes a recess 304 extending into the interior of the plate 301 and configured to provide a space for removably coupling the abrasive article 201. The plate 301 and abrasive article 300 are removably coupled to each other via coupling mechanisms 351 and 352 that include the engagement structures 257 and 258 of the abrasive article 250 engaged with complementary coupling surfaces 261 and 262 of the plate 301. That is, the plate 301 has particular shapes and coupling surfaces 261 and 262 particularly designed to be removably coupled to the abrasive article 250 having first and second working surfaces incorporating abrasive grains.

As illustrated, the abrasive tool 300 includes a plate 301 having a recess 304 such that the abrasive article 250 can be removably coupled to the plate 301 within the recess 304. In accordance with a particular embodiment, the recess 304 has a depth 305 as measured between the upper surface 331 of the plate 301 and the bottom surface 309 of the recess 304. Notably, the depth 305 of the recess 304 can be significantly greater than the height 335 of the abrasive article 200, such that the layer of abrasive grains 223 contained within the recess 304 are spaced apart from the bottom surface 309. Such an arrangement facilitates sufficient spacing between the bottom surface 309 and first layer of abrasive grains 223 to avoid destruction, dulling, or altering of the characteristics and orientation of the abrasive grains 223.

As further illustrated, the abrasive tool 300 is designed such that the abrasive article 250 is particularly situated within the recess 304 of the plate 301. That is, the upper major surface 202 of the substrate 201 can be flush with the upper surface 331 of the plate 301 such that only the bonding layer 203 and layer of abrasive grains 221 extend above the upper surface 331 of the plate 301. Such a configuration facilitates the engagement of the layer of abrasive grains 221 during a conditioning process and apt spacing between the upper surface 331 of the plate 301 and the pad during a dressing operation. The orientation between the abrasive article 250 and plate 301 in such a manner can be facilitated by the coupling mechanisms 351 and 352 which facilitate fixing the orientation between the abrasive article 250 and the plate 301.

The plate can include a material that is suitable for use in CMP processing. For example, the plate 301 can include the same material as that used in the substrate or support member. In specific implementations, the plate 301 is formed of a material having suitable mechanical characteristics, such as an elastic modulus of at least 2E3 MPa. For example, plate 301 can be made of a material having an elastic modulus within a range between about 2E3 MPa and about 4E5 MPa.

Some suitable materials for use as the plate 301 can include metals, metal alloys, polymers, and a combination thereof. For instance, in certain embodiments, the plate 301 is made of a metal material, such as a metal alloy, and particularly including transition metal elements. Alternatively, the plate 301 can include a polymer material, such that the plate is made of a durable polymer such as a thermoplastic, thermoset, or resin material.

In some embodiments the plate 301 is designed to withstand repetitive CMP processing and dressing procedures. That is, the plate 301 is intended to be a reusable member, such that it may undergo many uses before being replaced. For instance, the plate 301 can be designed such that it is reusable for a lifetime extending beyond that of the abrasive article 250.

The plate 301 can include recesses 302 and 303 configured for engagement with a fixture typically designed to hold the dresser, such that the plate 301 and abrasive article 250 can be rotated in accordance with a dressing operation. It will be appreciated that while the plate 301 is illustrated as having recesses 302 and 303 for engagement with a fixture, other engagement structures may be used such as an arbor hole through the center of the plate 301 or other structures suitably designed such that the plate 301 can be rotated with the abrasive article 200 for conditioning and dressing of a CMP pad.

Various means can be used for coupling the abrasive article to the plate, as described, for instance, in U.S. patent application Ser. No. 12/651,326, with the title of Abrasive Tool for Use as a Chemical Planarization Pad Conditioner, filed Dec. 31, 2009, which is incorporated herein by reference in its entirety. Features and engagement structures can include a variety of connections, such as interference fit connections, latches, fasteners, levers, clamps, chucks, or a combination thereof. Certain coupling mechanisms may include magnetic coupling devices and/or electrode coupling devices (e.g., anodic bonding) between the abrasive article 250 and the plate 301.

In one example, an abrasive tool includes sealing means that can reduce or minimize penetration of CMP fluids and debris into the connection between the abrasive article 250 and the plate 301. Otherwise, such materials may contaminate other pads in subsequent dressing operations. Sealing members can be attached to plate 301, substrate 201 or both. In one implementation, a sealing member may extend in a direction along the periphery of the side surface 206 of the substrate 201. That is, the sealing member can extend circumferentially (in the case of a circular substrate) around the entire periphery of the side surface of the substrate 201. Likewise, the sealing member can be engaged with a corresponding recess and extend along the periphery, and particularly the entire periphery, of the side surface of the substrate 201. In one example, the sealing member is disposed within a recess along the side surface of the substrate 201.

In another example, an abrasive tool for use as a CMP pad conditioner includes an abrasive article made of a substrate having a first major surface and a second major surface opposite the first major surface, a first layer of abrasive grains attached to the first major surface, and a second layer of abrasive grains attached to the second major surface. A plate includes a magnet for removably coupling the plate and the abrasive article.

In still another example, an abrasive tool for use as a CMP pad conditioner includes a plate, e.g., a metal or metal alloy plate, comprising a recess, and an abrasive article removably coupled within the recess. The abrasive article includes a substrate having a first major surface and a first layer of abrasive grains attached to the first major surface. In some instances the first layer of abrasive grains has a flatness of not greater than about 0.02 cm as measured by optical auto-focusing technology. For example, the first layer of abrasive grains can have a flatness of not greater than about 0.01 cm, or even not greater than about 0.005 cm. In one example, flatness measurements are gathered using optical auto-focusing technology to measure distance between points. An example of such technology is the Benchmark 450™ commonly available from VIEW Engineering, Inc.

In a further example, a CMP pad conditioner has a substrate (support) including a first major surface and a second major surface opposite the first major surface, a first layer of abrasive grains attached to the first major surface, and a second layer of abrasive grains attached to the second major surface. The abrasive tool can further include a first indicia on the substrate corresponding to the first major surface and identifying a wear status of the first layer of abrasive grains. Optionally, indicia can be provided in similar fashion to indicate a wear status of the second layer of abrasive grains.

Such indicia can identify the number of times the first and/or second layer of abrasive grains has been used in a conditioning operation and/or can aid a user in identifying the side that is used versus a side that is unused, and can identify the remaining useable life of a corresponding layer of abrasive grains. The indicia can include physical markings or printed markings, such as roman numerals, indicating the number of times the respective layer of abrasive grains 221 and 223 have been used. Color indicators, wherein the indicia have different color states identifying the wear status of the respective layer of abrasive grains, also can be utilized. In particular, the color indicators can have various color states wherein the color of the indicia changes with repetitive exposure to certain chemicals used in the CMP process. The indicia may be a score or user implemented material, such as a piece of adhesive or tape or other identifying structure indicating the number of times a layer of abrasive grains has been used and ultimately the wear status of the layer of abrasive Abrasive articles such as those disclosed in U.S. patent application Ser. No. 12/651,326, with the title of Abrasive Tool for Use as a Chemical Planarization Pad Conditioner, filed Dec. 31, 2009 and incorporated herein by reference in its entirety can be prepared by various methods. For instance, as described in U.S. patent application Ser. No. 12/651,326, a method of forming an abrasive article includes the steps of placing a first bonding layer material on a first major surface of a substrate, wherein the substrate comprises an engagement structure configured to removably couple the substrate to a plate, and placing a first layer of abrasive grains within the first bonding layer material. The method further includes placing a second bonding layer material on a second major surface of the substrate, wherein the second major surface is opposite the first major surface, placing a second layer of abrasive grains within the second bonding layer material, and forming a CMP pad conditioner comprising a first abrasive surface defined by the first layer of abrasive grains on the first major surface and a second abrasive surface defined by the second layer of abrasive grains on the second major surface.

Placement of the second bonding layer material can include processes that are similar to, or the same as, the placement of the first bonding layer material on the first major surface. In particular processes, the placement of the second bonding layer may include suspension of the substrate such that the completed first bonding layer material and the first layer of abrasive grains are not in contact with any surfaces. Suspension of the substrate while forming the second bonding layer avoids a change in the placement or orientation of the first layer of abrasive grains, or even dulling of the first layer of abrasive grains. The substrate may be suspended using mechanical means, pressurized means, or the like.

Arrangements that include two sided abrading surfaces can include the same or different abrasive materials and/or grain sizes on the two opposite faces of the support member. Thus the abrasive grains at the second abrading face can be the same as the abrasive grains at the first face, including the same type of material and the same average grit size. However, in particular embodiments, the abrasive grains of the second layer can be different from the abrasive grains used in the first layer of abrasive grains. Use of different abrasive grains between the first major surface and second major surface may facilitate formation of an abrasive article capable of conducting different dressing operations. For example, the abrasive grains of the second layer may contain a different type of material than the abrasive grains of the first layer. In some designs, the abrasive grains of the second layer can have a different average grit size for completing a different dressing operation either on the same CMP pad or a different type of CMP pad.

Approaches that can be employed to couple or attach abrasive particles to at least one side of the support member, typically the working face, or to both sides (opposite from one another, as described above), include, for instance, brazing, electroplating or sintering (e.g., using metal powder technology). Other types of bonding materials include, for instance, organic resins or vitrified bonds. The coupling means employed to attach abrasive grains to opposite abrading faces of a support member can be the same or different.

In one example, the abrasive grains are coupled by brazing with a brazing alloy. For instance, a brazing layer, e.g., brazing film, can be bonded to one or more sides of the support member. Abrasive particles are then applied, for instance by positioning abrasive particles on the layer(s) of braze to form a green part. Firing the green part melts the braze layer and is followed by cooling, to chemically bond the abrasive particles with brazing alloy to the support member. The chemical composition of metal bonds typically employed to couple abrasive grains such as diamonds to the substrate, e.g., a steel preform, often include elemental Ni plating or brazes, e.g. Nicrobraz® LM (BNi-2) braze from Wall Colmonoy Corporation, Madison Heights, Mich. Many of the braze films used in the arrangements described herein include a nickel alloy having a chromium content of at least about 2% by weight.

The brazing film can have a thickness, that is, for instance, between about 1% and about 60% of the smallest particle size of the abrasive particles employed and can be, for instance, braze tape, braze foil, braze tape with perforations, or braze foil with perforations. With perforated foil, for example, positioning abrasive particles on the layer(s) of braze may include, for example: applying adhesive to all layers of braze; positioning a placement foil or tape having a plurality of openings on each layer of adhesive; and contacting the abrasive particles with the adhesive through the openings.

In one implementation, the support member is a stainless steel disk, the brazing film is brazing foil and the abrasive particles are diamonds. In one case, at least about 50% (by weight) of the diamonds have, independently, a particle size between about 65 micrometers and about 75 micrometers.

Positioning the abrasive particles may include, for example, applying the abrasive particles to a plurality of openings in or on at least a portion of a brazing film, wherein each opening is configured to receive one of the abrasive particles. Applying the abrasive particles to a plurality of openings in or on at least a portion of the brazing film may include, for example, applying a layer of adhesive to at least one portion of the brazing film, positioning a placement guide comprising at least a portion of the plurality of openings on the layer of adhesive, and contacting the abrasive particles with the adhesive through the openings. In another approach, positioning the abrasive particles may include, for example, applying adhesive to at least a portion of the brazing film, and randomly distributing the abrasive particles on the adhesive.

The conditioning tool can be provided with a specific surface topography which, when used, achieves the desired pad conditioning and CMP conditioners can be manufactured to have a number of configurations. The abrasive grains may be positioned, for example, in the form of one or more patterns and, in turn, a pattern may comprise one or more sub-patterns.

Each pattern can have objects that define a border and accordingly a shape of the pattern. Various pattern shapes can be utilized. In some cases, the shape of the pattern is adjusted to be similar to the shape of the side of the support member (e.g., if the support member has a circular side, the pattern has a circular shape).

Examples of patterns that can be utilized include face centered cubic pattern, cubic pattern, hexagonal pattern, rhombic pattern, spiral pattern, random pattern, and combinations of such patterns. Hexagonal pattern, for instance, refers to an arrangement of objects in which each object that does not define the border of the pattern has six objects surrounding it in equal distance. One or more sub-patterns and one or more random patterns may be combined to form mixed patterns. Random abrasive grain patterns (e.g., where grains are randomly distributed on the substrate) can be used as well. Such patterns can include pseudo-random and chaotic or fractal patterns.

In tools that have two working (abrading) surfaces, patterns can be provided to only one or to both surfaces.

In one example, an abrasive tool includes a CMP pad conditioner made of a substrate having a first major surface and a second major surface opposite the first major surface, wherein the first major surface includes an abrasive texture including a first upper surface defined by upper portions of a first set of protrusions extending from a lower surface defined by a first set of grooves separating the first set of protrusions. The second major surface includes an abrasive texture including a second upper surface defined by upper portions of a second set of protrusions extending from a lower surface defined by a second set of grooves separating the second set of protrusions. Arrangements that employ two abrading surfaces can use the same or different patters to form the sets of groves and protrusions on the respective surfaces.

Traditionally, diamond grains generally have been placed on a conditioner surface in either random distribution or patterned distribution. A conditioner with a regular patterned array can have inherent periodicity of diamond in Cartesian coordinates which may imprint undesirable regularity on the pad. Truly random arrays, on the other hand, tend to generate diamond free zones. A self-avoiding random distribution (SARD™) was developed by Saint-Gobain Abrasives, Inc. to overcome these shortcomings. In general, a SARD™ array can be designed so that there is no repeat pattern, and also no diamond free zones. Furthermore, each SARD™ conditioner can be fabricated with exact duplication of each diamond position to provide superior polishing performance in terms of process stability, lot-to-lot consistency, and wafer uniformity. In tools such as described U.S. patent application Ser.

No. 12/651,326, with the title of Abrasive Tool for Use as a Chemical Planarization Pad Conditioner, filed on Dec. 31, 2009 and incorporated herein by reference in its entirety, SARD™ techniques can be utilized to generate one or both abrading surfaces.

CMP conditioning tools configured according to the SARD™ pattern are described, for example, in U.S. Pat. No. 7,507,267 issued to Richard W. J. Hall et al. on Mar. 24, 2009, the teachings of which are incorporated herein by reference in their entirety.

In preferred aspects, a tool for conditioning a CMP pad includes abrasive grains, bond and a substrate, the abrasive grains having a selected maximum diameter and a selected size range, and the abrasive grains being adhered in a single layer array to the substrate by the bond, characterized in that: (a) the abrasive grains are oriented in the array according to a non-uniform pattern having an exclusionary zone around each abrasive grain, and (b) each exclusionary zone has a minimum radius that exceeds the maximum radius of the desired abrasive grain grit size.

A method for manufacturing abrasive tools having a selected exclusionary zone around each abrasive grain includes the steps of (a) selecting a two-dimensional planar area having a defined size and shape; (b) selecting a desired abrasive grain grit size and concentration for the planar area; (c) randomly generating a series of two-dimensional coordinate values; (d) restricting each pair of randomly generated coordinate values to coordinate values differing from any neighboring coordinate value pair by a minimum value (k); (e) generating an array of the restricted, randomly generated coordinate values having sufficient pairs, plotted as points on a graph, to yield the desired abrasive grain concentration for the selected two dimensional planar area and the selected abrasive grain grit size; and centering an abrasive grain at each point on the array.

Another method for manufacturing abrasive tools having a selected exclusionary zone around each abrasive grain includes the steps of (a) selecting a two-dimensional planar area having a defined size and shape; (b) selecting a desired abrasive grain grit size and concentration for the planar area; (c) selecting a series of coordinate value pairs $(x_1, y_1)$ such that the coordinate values along at least one axis are restricted to a numerical sequence wherein each value differs from the next value by a constant amount; (d) decoupling each selected coordinate value pair $(x_1, y_1)$ to yield a set of selected x values and a set of selected y values; (e) randomly selecting from the sets of x and y values a series of random coordinate value pairs (x, y), each pair having coordinate values differing from coordinate values of any neighboring coordinate value pair by a minimum value (k); (f) generating an array of the randomly selected coordinate value pairs having sufficient pairs, plotted as points on a graph, to yield the desired abrasive grain concentration for the selected two dimensional planar area and the selected abrasive grain grit size; and (g) centering an abrasive grain at each point on the array.

Desired inter-particle spacings can be achieved, for example, by using an abrasive placement guide that has openings with a corresponding inter-opening spacing. In some cases, a specific pattern can be integrated into the brazing film. For instance, the brazing film (e.g., foil) can be provided with a plurality of openings or perforations in the desired pattern. In preferred implementations, each perforation is sized for holding a single abrasive particle so that post-firing the abrasive grains form a grain pattern substantially similar to the pattern of openings. Perforations also can allow outgassing of volatized adhesive during brazing, thereby reducing lift-up of the brazing film.

The tool can have an abrasive particle concentration of greater than about 4000 abrasive particles/square inch (620 abrasive particles/square centimeter or $cm^2$) and an inter-particle spacing so that substantially no abrasive particles are touching other abrasive particles (e.g., less than 5% by volume of abrasive particles are touching other abrasive particles). In some such cases, the abrasive particle concentration is greater than about 10000 abrasive particles/square inch (1550 abrasive particles/$cm^2$).

Other types of CMP pad dressers can be utilized. For example, suitable CMP dressing tools are described in U.S. Patent Application Publication No. 2008/0271384 published on Nov. 6, 2008 with the title Conditioning Tool and Techniques for Chemical Mechanical Planarization, the teachings of which are incorporated herein by reference in their entirety; and in U.S. Patent Application Publication No. 2009/0053980 to Hwang et al., published on Feb. 26, 2009 with the title Optimized CMP Conditioner Design for Next Generation Oxide/Metal CMP, the teachings of which are incorporated herein by reference in their entirety.

In one implementation, a tool for CMP pad conditioning includes abrasive grains, bond, and a substrate. The abrasive grains are adhered in a single layer array to the substrate by the bond, (e.g., braze tape or braze foil). The abrasive grains are optimized with respect to grain size, grain distribution, grain shape, grain concentration, and grain protrusion height distribution, thereby enabling a desirable CMP pad texture to be achieved. The abrasive grains can be oriented, for example, in the array according to a non-uniform pattern having an exclusionary zone around each abrasive grain, and each exclusionary zone has a minimum radius that exceeds the maximum radius of the desired abrasive grain grit size. In one particular case, at least 50% (by weight) of the abrasive grains have, independently, a particle size of less than about 75 micrometers. In another particular case, the desirable CMP pad texture is a surface finish of less than 1.8 microns or micrometers (μm), Ra. In yet another particular case, the bond that adheres the abrasive grains to the substrate is one of braze tape or braze foil. In a further particular case, the desirable CMP pad texture provided by the tool is resistant to abrasive agglomeration, thereby reducing dishing on wafers processed by the pad.

The abrasive tool for CMP pad conditioning also includes a coating. The coating can be disposed at one or more of the brazed, sintered or electroplated CMP dresser surfaces. For instance, the coating is applied to the working surface of a dresser or conditioner, and, optionally, to other surfaces. In tools that have a single working surface, both the abrading face and the opposite non abrading face can be coated. A tool such as described, for example, in U.S. patent application Ser. No. 12/651,326, with the title of Abrasive Tool for Use as a Chemical Planarization Pad Conditioner, filed Dec. 31, 2009 and incorporated herein by reference in its entirety, can have one or both abrading surfaces coated. In further implementations, the plate (holder) is also coated in part or in its entirely. In some cases, the entire tool, including, if used, a plate such as described herein, is coated. In other cases, all metal-containing surfaces that come in contact with the CMP slurry are coated. The same or different types of coating can be applied to various parts of the CMP pad conditioning tool.

Figure 2:
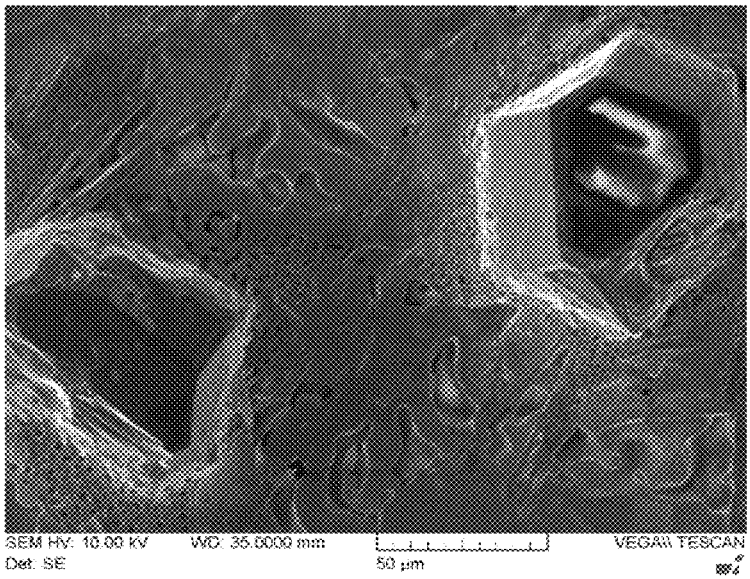
FIG. 2 is a scanning electron microscope image showing a porous metal bond microstructure (at surface and subsurface level) on a dresser surface after soaking in W2000 slurry.

Preferably the coating provides corrosion resistance and/or other properties, e.g., hydrophobicity, hardness, good adherence to the surface being coated, resistance to erosion, delamination or peeling and so forth. Corrosion generally refers to electrochemical degradation of metals or alloys due to reaction(s) with their environment, which often is accelerated by the presence of acids or bases. In general, the corrodibility of a metal or alloy depends upon its position in the activity series. Corrosion products often take the form of metallic oxides or halides. In the particular context of CMP applications, corrosion also refers to the dissolution of metals or alloy components into a corrosive solution, in this case the chemical slurry employed. This dissolution is induced by the electrochemical potential differences between the metal/alloy components involved. For instance, the Ni and $NiSi_2$ phases in the braze alloy act differently in either Cu or W slurry, the Ni phase generally being leached out ahead of $NiSi_2$. Typical results of corrosion phenomena in CMP applications include the porous metal bond microstructure that typically occurs at both surface and subsurface levels, as illustrated in FIG. 2.

Several types of coatings can be employed. Examples include but are not limited to organic/polymer/fluororesin, e.g., parylene, diamond-like carbon coatings (DLC), diamond-like nanocomposite coatings (DNC), fluorinated nanocomposite coatings and others, for instance, plated coatings, e.g., Cr, Ni, Pd and so forth.

Organic coatings based on polymers such as, for instance, parylene generally are hydrophobic but often are characterized by low wear resistance, especially in aggressive CMP applications, where the soft coating can be worn out or peeled off due, for example, to inadequate coating adhesion.

If aggressive abrasion is involved, which is, for instance, the case with diamond working surfaces, the worn diamond tip can continue to work while the rest of the bond areas can remain protected throughout the CMP process.

Diamond-like nanocomposite coatings are described, for example, in U.S. Pat. No. 5,352,493, Method for Forming Diamon-Like Nanocomposite or Doped-Diamond-Like Nanocomposite Films, issued on Oct. 4, 1994 to Dorfman et al., the teachings of which are incorporated herein by reference, in their entirety. Such coatings typically are amorphous materials characterized by interpenetrating random networks of predominantly sp3 bonded carbon stabilized by hydrogen, glass-like silicon stabilized by oxygen and random networks of elements from the 1-7b and 8 groups of the periodic table. Layered structures such as described, for instance, in U.S. Published Application No. 2008/0193649 A1, Coating Comprising Layered Structures of Diamond-Like Carbon Layers, to Jacquet et al., published on Aug. 14, 2008, the teachings of which are incorporated herein by reference in their entirety, also can be employed.

Standard DLC coatings, typically are hydrophilic (as are other metal coatings that can be employed). In some applications, DLC films can possess high intrinsic stresses, and as a result, may develop pin holes and overall porosity. These phenomena may lead to chemical corrosion and leaching, particularly in some CMP slurry environments. In addition, a hydrophilic surface can promote build up on the dresser surface during CMP applications, resulting in decreased dresser life and potential increases in defects (if residue particles break off from the dresser surface).

Therefore, in some aspects of the invention, the CMP conditioner has a coating that is hydrophobic. In further implementations, the coating is hard and/or has good adhesion to the substrate surface, and thus resists wear and/or peeling. Coatings that are inert, e.g., pH and/or chemical insensitive, also are preferred.

In specific embodiments, the coating is a fluorine-doped nanocomposite, also referred to herein as a fluorinated nanocomposite or F-DNC coating. Such coatings are nanocomposites of C, Si and O with doped F in the system and can be thought of as fluorine-doped diamond-like nanocomposite compositions.

In one implementation, the coating includes a diamond-like composition containing carbon, silicon, oxygen, hydrogen, and fluorine. Fluorine-doped diamond-like coatings are described, for instance, in U.S. Pat. No. 6,468,642, issued on Oct. 22, 2002 to Bray et al, the teachings of which are incorporated herein by reference in their entirety.

Without wishing to be bound by theory, it is believed that in some applications the coating composition is a carbon network chemically stabilized by hydrogen atoms, and a glass-like silicon network stabilized by oxygen atoms resulting in an amorphous structure, the fluorine being substitutionally incorporated and replacing a portion of either hydrogen or silicon. As used herein, "amorphous" refers to a random structure or arrangement of atoms in a solid state that results in no long range regular ordering, and lacks crystallinity or granularity. Since it is also believed that clusters can destroy the amorphous nature of the structure, and can serve as active centers of degradation, preferred coatings contain no clusters or ordering greater than about 10 Angstroms.

Optionally, the coating can include one or more other dopant(s) and such coatings are referred to herein as fluorine-dopant DNC coatings. Typically additional dopant(s) can be added to tailor or tune properties of the coating. For example, the dopant can be selected for added corrosion resistance or to enhance adherence to dresser surfaces being coated. The nature of the dopant and/or dopant concentration can be varied throughout the coating, e.g., in a layered arrangement.

The additional dopant may be any one, or a combination of, transition metals and non-metals of the groups Ib-VIIb and VIII of the periodic table. Examples of dopants include B, Si, Ge, Te, O, Mo, W, Ta, Nb, Pd, Ir, Pt, V, Fe, Co, Mg, Mn, Ni, Ti, Zr, Cr, Re, Hf, Cu, Al, N, Ag, Au. Some compounds which may be used as dopants include TiN, BN, AlN, ZrN and CrN. Other dopants may be employed. Further, silicon and oxygen atoms may also be used in the dopant networks with other elements and/or compounds.

Without wishing to be held to any specific interpretation, it is believed that additional dopants fill the nanopore network in a random fashion, eventually resulting, at a certain dopant concentration, in an additional network without clusters or microcrystalline grains, even at concentrations as high as 50 atomic %. At concentrations below about 10 atomic %, the dopants are distributed as separate atoms in the nanopores of the diamond-like matrix. The average distance between dopant atoms in this quasi-random structure can be controlled by the concentration of the dopant. When the relative concentration of the dopant element or compound reaches about 20-25 atomic %, the dopants form the third network in the fluorine-doped nanocomposite coating.

In many cases, the carbon content of the F-DNC or fluorine-dopant DNC coating is greater than about 40 atomic % of the coating, e.g. from about 40 to about 98 atomic %, and more preferably from about 50 to about 98 atomic %. Although such coatings may theoretically be prepared without any hydrogen, the hydrogen content is preferably at least about 1 atomic % up to about 40 atomic % of the carbon concentration.

The fluorine content of the F-DNC or fluorine-dopant DNC coatings can be at least about 1 atomic % up to about 40 atomic % of the carbon concentration. The fluorine content used may vary according, for example, to the specific CMP application. For instance, the fluorine amount employed can be selected to be high enough to provide hydrophobic properties, yet not so high as to render the coating too soft for the desired application. Fluorine amounts can be within the range of from about just above 0% (e.g., 0.5%), to about 30% by atomic volume, more preferably within the range of from about 1% to about 20% by atomic volume.

The density of the F-DNC coating can vary, e.g., from about 1.8 to about 2.1 g/cm$^3$. The rest of the space can be taken up by a random network of nanopores with diameters varying from about 0.28 to about 0.35 nm. Preferably, the nanopore network does not form clusters or micropores. In some cases, the coating can include a C—F/H network, a glass-like Si—O network, and, optionally, an additional dopant network. The random interpenetration of the different networks is believed to provide the uniform strength of the structures in all directions found in the coating. The coating structures preferably are free of micropores, e.g., through thicknesses as great as about 80 Angstroms (8 nm).

The thickness of the coating has no theoretical upper or lower limit, as existing technology and available equipment allow atomic-scale composite coatings. Typically, the coating is applied with a thickness suitable for specific CMP applications, e.g., within the range of from about 0.1 μm to about 5 μm. Preferably the coating is thick enough to withstand premature erosion at the working surface of the dresser, yet thin enough to control defects, cracking, delamination and so forth. In specific implementations, a tool for dressing a CMP pad has a coating that has a thickness within the range of from about 0.5 μm to about 3 μm.

The coating can be deposited in a single layers or multiple layers. For example, fluorine-DNC coatings may be layered with fluorine-doped DNC (which contain an additional dopant). Further to altering chemical composition, changes in properties from one layer to another also can be achieved by altering the deposition conditions, e.g., temperature, pressure and/or other parameters.

The composition, thickness and/or other characteristics of the coating can vary from one surface to another or can be substantially uniform for all surfaces that are coated.

The coating can be applied by any suitable method, for instance on an as-fired tool for conditioning CMP pads, e.g., one of the dressers described above, in which abrasive grains have been coupled to at least one side of the support. Suitable techniques include physical vapor deposition (PVD), chemical vapor deposition (CVD), elecrodeposition and others.

Various tool surfaces can be coated at the same time or sequentially. Any number of vacuum chamber designs, organosilicon and other precursors, precursor handling, precursor inlets, as well as various deposition approaches can be employed, e.g., as known in the art. Examples of suitable materials, equipment and methods that can be used to form coatings are described, for instance, in U.S. Pat. No. 6,468,642, Fluorine-Doped Diamond-Like Coatings, issued on Oct. 22, 2002 to Bray et al., assigned to N. V. Bekaert S. A., the teachings of which are incorporated herein by reference in their entirety.

In one embodiments, a method of making a CMP conditioner includes positioning (an as fired) CMP conditioner in a vacuum deposition chamber and depositing a diamond-like composition containing carbon, silicon, oxygen, hydrogen, and fluorine onto it by co-deposition of clusterless particle beams that include ions, atoms, or radicals of the carbon, silicon, oxygen, hydrogen, and fluorine. The mean free path of each particle species preferably is in excess of the distance between its source and the growing particle coating surface of the conditioner.

In another embodiment, a fluorine-doped diamond-like coatings can be applied to one or more surfaces of a CMP conditioner via co-deposition by clusterless beams of ions, atoms or radicals of the relevant elements, where the mean free path of each particle species preferably exceeds the distance between its source and the growing particle coating surface, and each beam contains particles of well-defined energy.

Prior to deposition, the tool, or specific surfaces thereof, can be cleaned to remove any organic or inorganic impurities contaminating dresser surfaces. Suitable cleaning processes that can be employed include, for instance ultrasonic and/or plasma methods or other suitable techniques, e.g., as known in the art.

In some cases, cleaning is integrated with deposition. For instance, an argon plasma can be generated first to effect the cleaning of a CMP dresser already present in the vacuum chamber, followed by introduction of precursors that form the coating.

In other cases, the overall process can be conducted in an air-to-air system. Such an air-to-air system can include cleaning, transport of parts, e.g., as fired CMP dressers, to the deposition chamber, and mechanized/robotic loading of the parts on the substrate holder. This is followed by entry of the substrate holder into the load-lock chamber, by entry into the deposition chamber, and coating onto the substrate, in this case, onto a tool for conditioning a CMP dresser. After coating, the substrate holder can be removed from the deposition chamber into a load-lock chamber, followed by exit into the atmosphere. The tool may be rotated, tilted, or otherwise oriented, manipulated, e.g., subjected to vibrations, while being mounted onto the holder, while on the substrate holder, and at other instances during processing.

Preferred coatings, e.g., F-DNC and fluorine-dopant DNC coatings, adhere well to the CMP dresser and can be applied directly, without utilizing an intermediate layer between CMP dresser surfaces and the coating. In use, the coating resists peeling or delamination. Not only are preferred coatings, e.g., F-DNC or fluorine-dopant DNC coatings, unreactive to many corrosive CMP environments, they also are believed to act as a barrier, preventing contact between the corrosive agent and the protected dresser surface.

Figure 3:
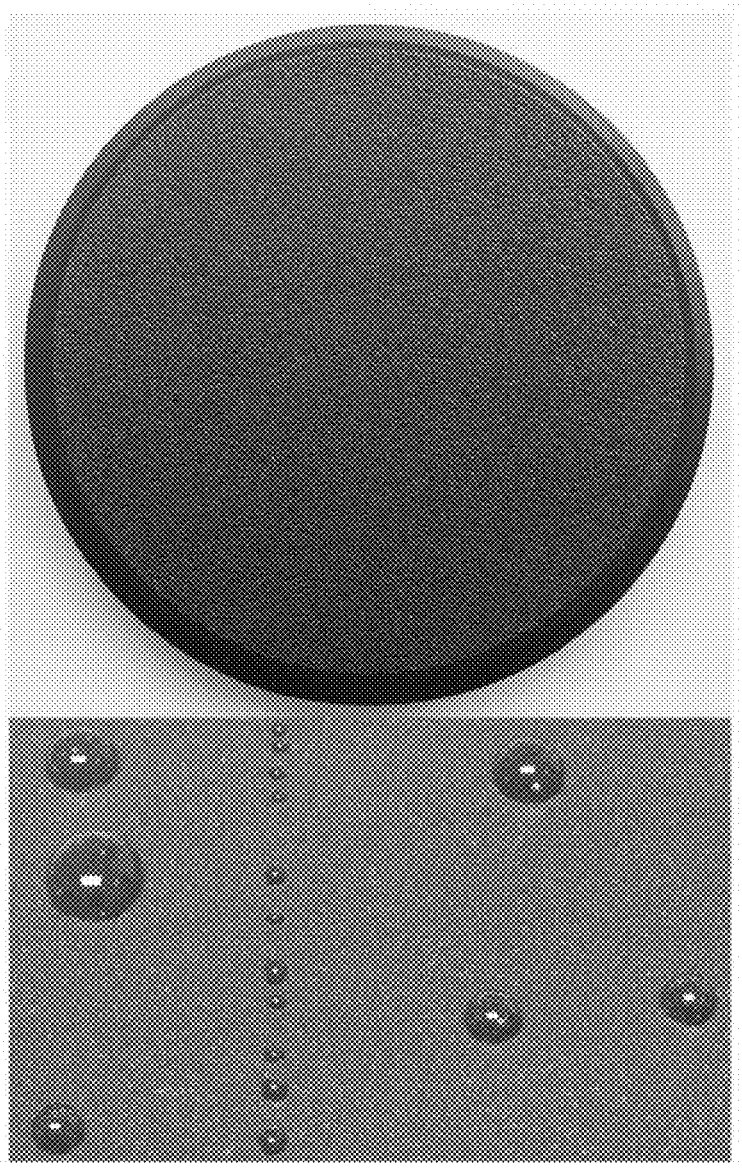
FIG. 3 is an image showing water droplets standing on a F-DNC coated dresser surface.
Figure 4:
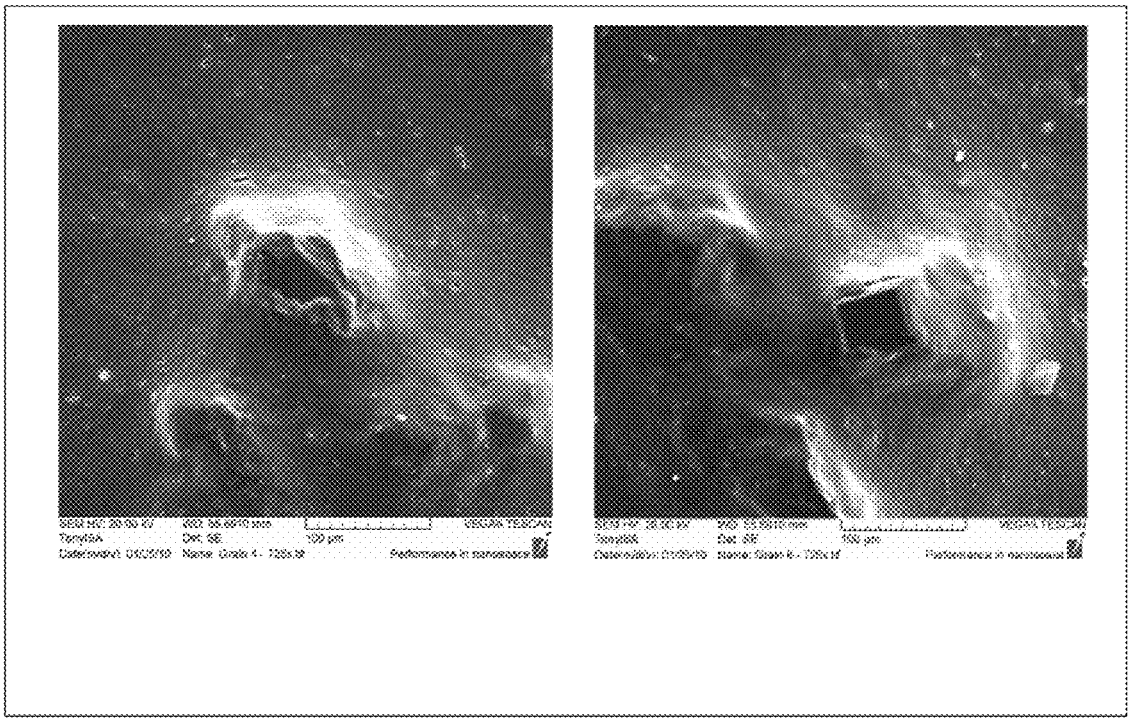
FIG. 4 is an image showing water droplets standing on a F-DNC coated dresser surface.

The coating employed, e.g., F-DNC, preferably renders dresser surfaces hydrophobic and a CMP conditioner surface that is water-repellent is illustrated in FIG. 3. An image showing water droplets standing on a F-DNC coated dresser surface is shown in FIG. 4.

Hydrophobic dresser surface tends to prevent or minimize CMP residue buildup and/or formation of tribological films. As a result, the dresser performance will be maximized or enhanced, since the diamonds will be in effect until all the performing sharp edges are dulled.

In many instances, the coatings have a high water contact angle, e.g., 105° and higher. In specific cases, the water contact angle can be within the range of from about 90° to about 120°.

Preferred coatings, e.g., F-DNC and fluorine-dopant DNC coatings also have hardness and durability. The fluorine-doped diamond-like coatings, especially the metal doped coatings, combine high microhardness with elasticity, thus the microhardness of the fluorine-doped diamond-like coatings of the present invention ranges from about 5 to about 32 GPa, e.g., about 15 GPa.

Without wishing to be bound by theory, it is believed that the low intrinsic stress found in F-DNC and fluorine-doped DNC coatings contributes to their corrosion resistance. For example, this low stress renders the coatings pore-free, and thus resists chemical attack and permeation. It is also believed that the presence of glass-like silicon stabilized by oxygen, serves to prevent the growth of graphitic carbon at high temperatures, to prevent metal cluster formation in metal-containing coatings, to reduce internal stresses in the coatings, thereby enhancing the adhesion to the CMP dresser surface(s). In turn, the coating can be applied in a thicker layer that has superior erosion resistance.

During operation the coated abrasive tools described herein can be used to dress and/or refurbish a CMP pad. In one example, a method for conditioning a CMP pad, comprises dressing a surface of the CMP pad with a tool that includes (a) abrasive grains coupled to a substrate through a metal bond; and (b) a coating at one or more surfaces of the tool, the abrasive grains having a selected maximum diameter and a selected size range, and the abrasive grains being adhered in a single layer array to the substrate by the bond, characterized in that the abrasive grains are oriented in the array according to a non-uniform pattern having an exclusionary zone around each abrasive grain, each exclusionary zone having a minimum diameter that exceeds the maximum diameter of the desired abrasive grain grit size.

In another example, a method for conditioning a CMP pad, comprises contacting a dresser with the CMP pad, wherein the dresser includes abrasive grains coupled to a substrate through a metal bond and a nanocomposite coating that contains carbon, silicon, oxygen, hydrogen, and fluorine at one or more surfaces of the dresser; and refurbishing a working surface of the CMP pad, thereby conditioning said pad.

In a further example, a method of dressing a CMP pad comprises coupling an abrasive article to a dressing machine, the abrasive article comprising a substrate having a first major surface and a second major surface opposite the first major surface, wherein the abrasive article comprises a first abrasive surface at the first major surface of the substrate, and a second abrasive surface at the second major surface of the substrate, at least one of said abrasive surfaces being coated, and wherein the abrasive article is mounted on the dressing machine to expose the first abrasive surface; contacting the first abrasive surface to a surface of a first CMP pad and moving the first CMP pad relative to the first abrasive surface to condition the first CMP pad; inverting the abrasive article to expose the second abrasive surface; and contacting the second abrasive surface to a surface of a second CMP pad and moving the second CMP pad relative to the second abrasive surface to condition the second CMP pad.

Conditioning operations utilizing coated abrasive tools such the tools described herein can be carried out using equipment, e.g., dressing machines, and process parameters as known in the art.

The invention is further illustrated through the following examples which are not intended to be limiting.

EXAMPLE 1

Tests were conducted to assess leaching levels for Ni and Cr. It was found that these levels were significantly reduced in a hydrophobic CMP dresser according to embodiments of the invention, compared to a CMP dresser that did not include a F-DNC coating. Results showing the elemental leaching, in microgram/ml (ppm) for a tungsten slurry, after seven days of soaking, are presented in Table 1 below.

TABLE 1

Elemental leaching W slurry (after 7 days soaking)

| Sample ID | Uncoated Dresser (7 days) | F-doped DNC dresser (7 days) |
|---|---|---|
| Ag | <0.02 | <0.02 |
| Al | 0.11 | <0.03 |

TABLE 1-continued

Elemental leaching W slurry (after 7 days soaking)

| Sample ID | Uncoated Dresser (7 days) | F-doped DNC dresser (7 days) |
|---|---|---|
| Au | <0.05 | <0.05 |
| Ca | 0.75 | <0.2 |
| Cr | 13.8 | 2.1 |
| Cu | 0.25 | 0.17 |
| Fe | 126 | 54 |
| K | 0.6 | 0.4 |
| Li | <0.01 | <0.01 |
| Mg | 1.06 | 0.55 |
| Na | 0.09 | <0.02 |
| Ni | 326 | 48 |
| Zn | 2.01 | 0.23 |

Unit: microgram/ml (ppm)

EXAMPLE 2

Figure 5:
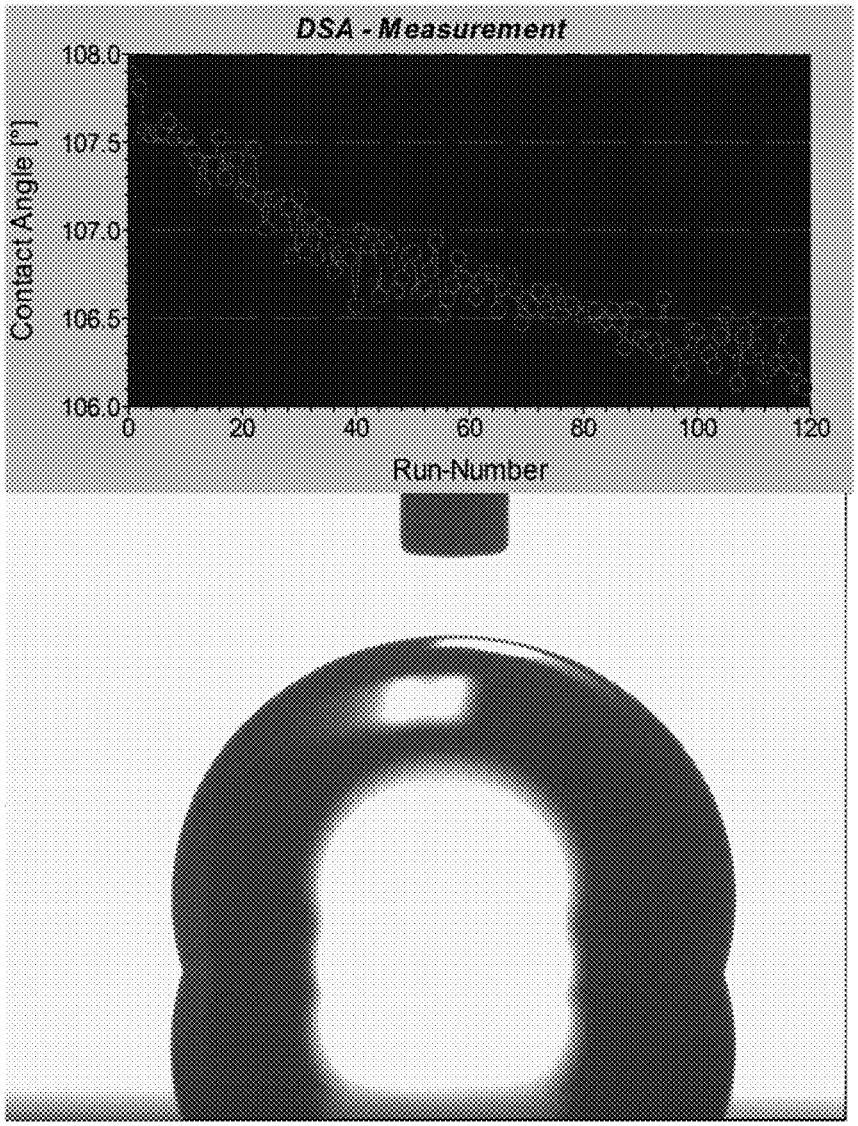
FIG. 5 shows contact angle measurement results for one F-DNC coated dresser surface.

A hydrophobic F-DNC coating having a thickness of 2.5 μm was deposited on a working surface of a CMP dresser made on 430 stainless steel with diamonds in the size range of 65 μm to 85 μm. The coating had a contact angle of about 108°, as measured using a DSA 100 Drop shape Analysis System from Kruss GmbH, Hamburg, Germany. The data are presented in FIG. 5.

In another example, the contact angle measured was 105°.

EXAMPLE 3

A tool included an abrasive article with two working surfaces and a plate (holder) as described herein. A DLC coating was applied on both working surfaces. The coating had a thickness of 1.5 micron (+/−10%). The tool exhibited reduced chemical leaching when compared with traditional brazed or sintered CMP dresser products. The tool can be used in both metal, such as, for instance, Cu and/or W, as well as in oxide, e.g., Interlayer Dielectric (ILD) or Shallow Trench Isolation (STI) CMP environments.

While this invention has been particularly shown and described with references to preferred embodiments thereof, it will be understood by those skilled in the art that various changes in form and details may be made therein without departing from the scope of the invention encompassed by the appended claims.

The Abstract of the Disclosure is provided solely to comply with U.S. requirements and, as such, is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

What is claimed is:

1. An abrasive tool for conditioning a CMP pad, the tool comprising:

a plate;

a substrate having a first major surface and a second major surface opposite the first major surface and a coupling surface having a depression configured for complementary engagement with the plate;

a first single layer of abrasive grains coupled to the first major surface through a first metal bond;

a second single layer of abrasive grains coupled to the second major surface through a second metal bond; and a first coating at the first major surface and a second coating on the second major surface, wherein the first and the second coating are each selected from the group consisting of organic polymer fluororesin compositions, diamond-like carbon coatings, diamond-like nanocomposite coatings, and fluorinated nanocomposite coatings, and wherein the plate and the abrasive article are removably coupled via a coupling mechanism configured for reversible operation of the abrasive tool, and wherein the first single layer of abrasive grains and the second single layer of abrasive grains are spaced apart from the plate.

2. The abrasive tool of claim 1, wherein at least one of the first coating and the second coating further includes at least one additional dopant.

3. The abrasive tool of claim 1, wherein at least one of the first coating and the second coating is hydrophobic.

4. The abrasive tool of claim 1, wherein the first coating and the second coating are each corrosion resistant.

5. The abrasive tool of claim 1, wherein the first coating and the second coating each has a thickness within the range of from about 0.1 microns to about 5 microns.

6. The abrasive tool of claim 1, wherein the abrasive grains are coupled to the substrate through brazing, electroplating or sintering.

7. The abrasive tool of claim 1, wherein all metal-containing surfaces are coated.

8. The assembly of claim 1, wherein the coupling mechanism includes an engagement structure at the substrate configured to removably engage a coupling surface of the plate.

9. The assembly of claim 8, wherein the coupling mechanism includes a structure selected from the group of structures consisting of latches, fasteners, clamps, interference fit connections, and a combination thereof.

10. The assembly of claim 1, wherein the plate includes a magnet for removably coupling the plate and the abrasive article.

11. The assembly of claim 1, wherein the plate is coated.

12. The abrasive tool of claim 1, wherein each abrasive grain is located at a point on the array that has been defined by:

(a) restricting a series of coordinate value pairs $(x_1, y_1)$ such that the coordinate values along at least one axis are restricted to a numerical sequence wherein each value differs from the next value by a constant amount;

(b) decoupling each selected coordinate value pair $(x_1, y_1)$ to yield a set of selected x values and a set of selected y values;

(c) randomly selecting from the sets of x and y values a series of random coordinate value pairs (x, y), each pair having coordinate values differing from coordinate values of any neighboring coordinate value pair by a minimum value (k); and (d) generating an array of the randomly selected coordinate value pairs having sufficient pairs, plotted as points on a graph, to yield the exclusionary zone around each abrasive grain.

13. The abrasive tool of claim 1, wherein the coating includes more than one layer.

14. The abrasive tool of claim 1, wherein the coating has a contact angle within the range of from about 90° to about 120°.

15. The abrasive tool of claim 1, wherein the abrasive grains are single diamond particles.

16. An assembly, comprising:

a plate having a recess with a depth;

an abrasive tool for conditioning a CMP pad removably coupled to the plate in the recess, the abrasive tool having abrasive grains coupled to a substrate through a metal bond and a first coating on a first major surface of the substrate and a second coating on a second major surface of the substrate, the second major surface of the substrate being opposite the first major surface, wherein the first coating and the second coating are each selected from the group consisting of organic polymer fluororesin compositions, diamond-like carbon coatings, diamond-like nanocomposite coatings, and fluorinated nanocomposite coatings; and the abrasive tool has a height that is less than the depth of the recess, such that the abrasive grains on one of the major surfaces in the recess are spaced apart from a bottom surface of the recess, and wherein the plate and the abrasive tool are removably coupled via a coupling mechanism configured for reversible operation of the abrasive article.

17. An assembly according to claim 16, wherein the plate and abrasive tool are coupled at inner side walls of the recess and outer side walls of the abrasive tool.

18. An assembly according to claim 16, wherein an upper major surface of the substrate is flush with an upper surface of the plate, such that only the abrasive grains, the metal bond and the coating on one of the working surfaces extend above the upper surface of the plate.

* * * * *